US008151405B2

(12) United States Patent
Giannantonio

(10) Patent No.: US 8,151,405 B2
(45) Date of Patent: Apr. 10, 2012

(54) DRYWALL TROWEL

(76) Inventor: Nicholas Giannantonio, Tonawanda, NY (US)

( * ) Notice: Subject to any disclaimer, the term of this patent is extended or adjusted under 35 U.S.C. 154(b) by 306 days.

(21) Appl. No.: 12/546,003

(22) Filed: Aug. 24, 2009

(65) Prior Publication Data

US 2011/0041277 A1 Feb. 24, 2011

(51) Int. Cl.
*E04F 21/16* (2006.01)

(52) U.S. Cl. ..... 15/235.7; 15/236.06; 15/236.09; 15/245.1; 425/458; D8/45; D32/49

(58) Field of Classification Search ..... 15/235.4–235.8, 15/236.01, 236.05, 236.06, 236.09, 245.1; 425/458; D8/45; D32/46, 49
See application file for complete search history.

(56) References Cited

U.S. PATENT DOCUMENTS

| | | | | |
|---|---|---|---|---|
| 1,156,209 | A * | 10/1915 | Churchill | 15/245.1 |
| 1,498,509 | A * | 6/1924 | Arnold | 416/71 |
| 2,008,952 | A * | 7/1935 | Gach | 15/245.1 |
| 2,472,668 | A * | 6/1949 | Lewandowski | 30/169 |
| 2,730,756 | A * | 1/1956 | Greene | 425/458 |
| 3,079,622 | A * | 3/1963 | Smyers et al. | 15/235.7 |
| 5,067,889 | A | 11/1991 | Humiston | |
| 5,192,558 | A | 3/1993 | Sparrow et al. | |
| 5,467,497 | A | 11/1995 | Greene et al. | |
| 5,544,384 | A | 8/1996 | Forselius et al. | |
| 5,774,924 | A | 7/1998 | Beckham et al. | |
| 5,792,489 | A | 8/1998 | Liberman | |
| 6,523,219 | B1 * | 2/2003 | Anderson | 15/257.01 |
| 6,880,198 | B1 | 4/2005 | Hazard | |

FOREIGN PATENT DOCUMENTS

JP 7-241514 * 9/1995

* cited by examiner

*Primary Examiner* — Mark Spisich
(74) *Attorney, Agent, or Firm* — Kloss Stenger LoTempi; Vincent LoTempio; Brendan Lillis

(57) ABSTRACT

A tool for spreading viscous material comprising a sheet of resilient material having a inner face and an outer face, a handle attachment edge and a forward edge. The sheet being bent from the outer face toward the inner face along a bend line to form a V-shaped point to shape an offset corner blade and at least one substantially flat surface blade from the forward edge, and a handle for gripping the tool attached to the handle attachment edge of the sheet distal distally from the bend line.

9 Claims, 2 Drawing Sheets

DRYWALL TROWEL

BACKGROUND OF THE INVENTION

This invention pertains generally to spreading tools for applying viscous materials, particularly to devices for applying viscous materials to a surface efficiently while producing a uniform layer of material, and more particularly to a device for smoothly applying viscous materials along two planar surfaces having a common edge simultaneously with substantially no excess material applied to any surface.

During the building or repair of physical structures, various viscous materials are used to fill and/or seal cracks and gaps in and between structural elements. Examples of viscous materials are caulk, cement, joint compound, spackle, and grout. Numerous tools have been developed to apply the various viscous materials to any number of building materials, such as wood, concrete, sheet rock, drywall, asphalt, cinder, etc. One such style of tool is a caulking-gun which applies a thin bead of material to intersections between one wall and other surface. Caulking-guns are generally used in sealing bathtub, shower, and tile seams. However, the thin bead is not generally spread or smoothed once it is applied, and because of the thin bead, a wide swath is not possible.

Alternatively, spreading tools consisting of one or more blade edges are laid flat against a surface and pulled downward spreading the viscous material. Traditionally, three separate tools are needed—one for applying material to an inside corner, one for applying material to an outside corner, and a third for applying material along a flat surface. Conventional corner tools do not uniformly distribute pressure exerted by the user. The inside corner tool must be laid flat against the corner, pushed in, and pulled down. As a result of this non-uniform pressure distribution, the drywall tape gets caught on the bottom of the tool. This snagging begins pulling and dragging the tape off the wall. Often the user must go back and readjust the tape and start all over again. Moreover, this tool can only be used for inside corners. It has no other purpose. Except for the very skilled artisan this tool makes the job very time consuming and difficult. The outside corner tool is very similar to the inside corner tool but is designed specifically for outside corners. Due to the placement of the handle and the angle at which the tool is configured, it can only be used for outside corners. It too has no other purpose. Additionally, both of the current inside and outside corner tools are incapable of adding the viscous material to the surfaces prior to spreading. A flat surface tool is used to place an amount of the material onto the surface being worked upon and the corner tool is then used to spread and smooth that material. Therefore, when working on corner applications, at least two tools are needed—a flat surface tool and a corner tool. To simply matters, the flat surface tool is the tool most professionals use for corners obviating the need for a corner tool. The problem using this approach is that the sharp edge on the flat surface tool gouges the drywall tape in the corners. It is also difficult to keep a straight edge in inside corners with this tool. Additionally, the flat surface tool is configured to finish only one side of a corner at a time which slows down the finishing process because one must wait for one side of the corner to dry before applying compound to the other side. This additional time increases labor cost and decreases efficiency Examples of spreading tools are disclosed in the following patents: U.S. Pat. No. 5,067,889 issued to Humiston discloses a hand tool for smoothing joint compound in wide angle applications. The blade is designed to be flexible and to fit within angles formed by adjoining wall boards between 90 and 180 degrees. The blade has a crease in the center of one outer edge and a handle attached in the center of the opposite outer edge. Importantly, the crease is directly in line with the longitudinal midline of the handle. The handle position prevents a user from applying proper force during flat area applications.

In U.S. Pat. No. 5,192,558 to Sparrow an adjustable hand tool/trowel is discussed. The trowel has a first flat blade similar to that of a standard putty knife, but the blade has two spring-loaded attachments down its length extending from the handle. The handle of the trowel has a trigger mechanism which, when in operation, causes the blade to bend under the spring pressure. Various angles can be formed depending on the amount of pressure applied to the trigger. Importantly, this design is for flat surfaces and those above 180 degrees.

U.S. Pat. No. 5,467,497 issued to Greene discloses an adjustable hand tool/trowel having a hinge along the blade extending from the handle. The hinge is adjustable to fit internal angles made by adjoining walls. A locking pin bolt mechanism can be used to control the angle made by the blades. Importantly, the handle of the '497 patent is located along the pivot point and extended upwardly into the angle made by the folding blades. This layout prevents the trowel from being used on outside corners. Additionally, the locking pin mechanism disrupts the flat edge of the blade preventing its use in flat application scenarios.

In U.S. Pat. No. 5,774,924 issued to Beckham, et al a hand held tool/trowel having a thinned inner portion for flexible bending is disclosed. Each end of the blade has a pivoting mount. The mount is pivotally connected to a handle using a set of arms. The trowel is designed for use on outside angles formed by two pieces of drywall. The flexible hinge allows the blade to be used for applications between 180 and 270 degrees. The handle prevents it use for internal corner applications.

U.S. Pat. No. 5,792,489 issued to Liberman discloses a hand held tool/trowel for applying joint compound to interior corners formed by two layers of drywall. The trowel has a blade bent at 90 degrees and a handle attached to the acute portion of the bend. The external ends of the blade are bent outwardly from the handle. This additional bend forces the interior portion of the blade to lie flush against the opposing walls during application of compound. Importantly, this tool is designed for interior 90 degree corners. The handle, along with the additional bend, does not allow for use in flat surface applications. Further, the handle prevents the use of the tool for outside edge applications.

Finally, U.S. Pat. No. 6,880,198 to Hazard describes a hand held tool for application of viscous materials such as cement, caulk, and joint compound. The tool possesses a handle and blade wherein the blade has a forward working edge. Alongside the blade is an extension edge. The tool is designed to be used for acute angles. The compound is applied with the working edge while the extension edge prevents excess material from working around the working edge. When used on drywall, this tool is designed only to be used along one wall of the inside angle.

Therefore, it is clear that a need exists for a single multipurpose tool that quickly and easily applies viscous material to joints and corners so that the edges are smoothly covered with material along a distance of several inches from the corner. Furthermore, it is readily apparent that there is a long felt need for an all-in-one viscous material spreading tool capable of smoothly applying material to inside corners, outside corners, and flat surfaces.

SUMMARY OF THE INVENTION

It is the primary object of the present invention to provide a hand-held tool capable of smoothly spreading a viscous material to joints and corners, namely over wall board.

Still a further object of the present invention is to provide a hand-held tool that is made of a material that is lightweight and easy to manufacture.

It is another object of the present invention to provide a hand-held tool that quickly and evenly spreads viscous material over irregularities, such as tape edges, located on the wallboard surfaces to form a smooth, even surface.

It is still another object of the present invention to provide a hand-held tool that smoothly applies viscous material to the intersection of two walls, simultaneously.

It is yet another object of the present invention to provide a hand-held tool that smoothly applies viscous material to inside corners, outside corners, and flat surfaces, without requiring adjustment of the tool.

The above and other objects are accomplished in accordance with the present invention which generally comprises a tool for spreading viscous material made of a sheet of resilient material having a inner face and an outer face, a handle attachment edge and a forward edge; the sheet being bent from the outer face toward the inner face along a bend line to form a V-shaped point to shape an offset corner blade and at least one substantially flat surface blade from the forward edge, and a handle for gripping the tool attached to the rear edge of the sheet distal the bend line.

The sheet is constructed of a rigid yet flexible material such as a thin metal or plastic. The blade is angled to easily apply viscous material, such as joint compound, to the outside edge of two adjoining surfaces. The blade is sufficiently rigid to prevent its angle from being spread further as the joint compound is being applied. For inside angles, the flexibility of the blade allows the tool to fit snuggly into the corner while spreading the viscous material. Off-setting the handle on one face permits the tool to be used on flat surfaces without the handle getting in the way of the user's hand. Therefore, the application and smoothing of a viscous material to create a finished surface is effected in a single operation.

These and other objects, features and advantages of the present invention will become readily apparent to those having ordinary skill in the art upon a reading of the following detailed description in view of the appended claims and drawings.

DESCRIPTION OF THE DRAWINGS

The present invention and the manner in which it may be practiced is further illustrated with reference to the accompanying drawings wherein.

DETAILED DESCRIPTION OF THE INVENTION

Figure 1:
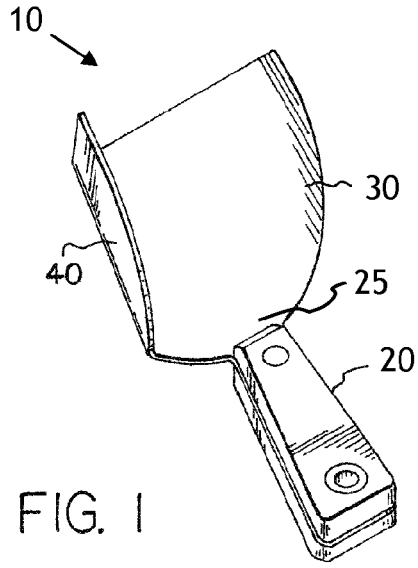
FIG. 1 is a perspective view of one embodiment of a trowel of the present invention.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

Traditionally, three separate tools are needed to smooth viscous material used to hide seams, nails or screws and cover corners of the surface area of planar sheets of drywall—one tool for applying viscous material to an inside corner, one for applying material to an outside corner, and a third for applying material along a flat surface. When using conventional tools the viscous material is often applied proportionately unequal. When a person applies viscous material using the standard inside or outside corner tool pressure is applied to various points of the corner in varying degree. This uneven pressure distribution forces a person skilled in the art to abandon the tool and use the straight edge tool. The straight edge tool is capable of applying viscous material to one side of the corner at a time and if not used correctly gouges the tape and does a poor job. A conventional inside or outside corner tool does not work well as a straight edge flat surface blade.

Wherein conventional tools are limited to only one application per tool, the tool of the present invention is used to spread viscous material on three surfaces; on one side of the tool it is configured to spread viscous material to an outside corner, the other side is used to spread material on an inside corner, and a flat surface blade is configured to spread material on a flat surface.

The trowel of the present invention uniformly disperses the pressure and applies the viscous material evenly in all three applications. In a preferred embodiment of the present invention the handle is operatively arranged away from the bend of the blade thereby allowing the user to simply flip the device over to apply the viscous material on either the inside corner or an outside corner. In addition on the present invention the handle is positioned relative to the bend in the blade so that the tool is in perfect balance. When using the straight edge on a flat surface the instant invention works in the same way a conventional putty knife would be used to apply a viscous material to an area and spread it out smoothly. This is especially true when first applying viscous material in the corners. A conventional inside or outside corner tool cannot be used to apply the initial viscous material in the location it is needed or to subsequently spread it out on a flat surface. It should be understood that the positioning of the handle relative to the bend of the metal sheet allows the even application and spreading of the viscous material. The positioning of the handle relative to the generally V-shaped tool allows pressure to be applied uniformly and distributed evenly along the corners and on flat surfaces.

Adverting now to the drawings, FIG. 1 is a perspective view showing a preferred embodiment of a trowel the present invention trowel 10. Trowel 10 is designed and configured to function as an all-in-one tool used to spread a viscous material to flat surfaces, inside corners, and outside corners. Trowel 10 is generally comprised of handle 20, flat surface blade 30, and corner blade 40. The handle is a generally rectangular ergonomic wooden handle, designed to fit comfortably in a user's hand during use. It should be appreciated by those of ordinary skill in the art that it is constructed of a lightweight yet rigid material such as metal, wood, plastic, or the like. Flat surface blade 30 and corner blade 40 are constructed of a sheet of metal generally shaped in a half circle. The sheet of metal having an outer face 45 and an inner face 47 with a generally V-shaped bend from the outer face toward the inner face forming flat surface blade 30, and corner blade 40. It is preferably constructed of a rigid yet flexible aluminum blade. It should be appreciated by those of ordinary skill in the art that other materials can be used in its construction such as molded plastic or other metals. Flat surface blade 30 is arranged to extend in a longitudinal direction from handle 20 and remain substantially parallel to handle so as to function as a conventional putty knife. Corner blade 40 extends generally perpendicularly from flat surface blade 30 and is used in combination with the end portion of blade 30 to form the tool used to apply viscous compound on both inside and outside corners. The generally half circle shape as shown in FIG. 1 is for illustration purposes only and it should be readily apparent to those of ordinary skill in the art that trowel 10 could be made in any suitable shape, such as a wedge, triangle, rectangle or square.

Figure 2:
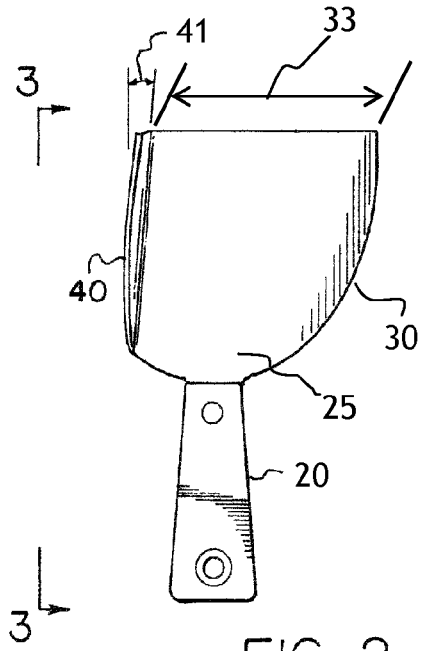
FIG. 2 is a top view of one embodiment of a trowel of the present.
Figure 4:
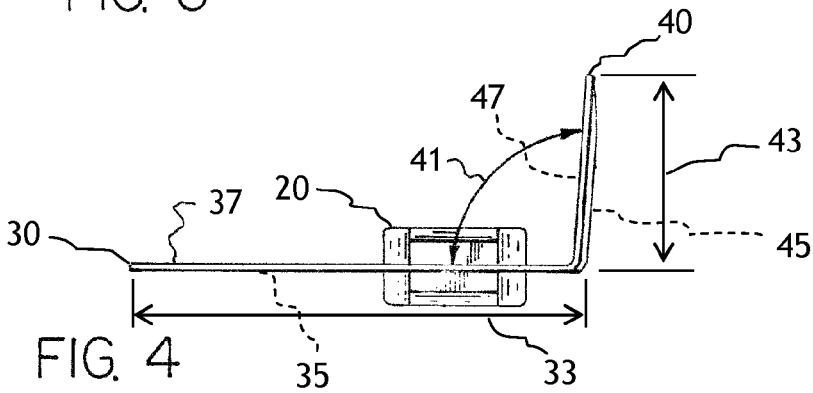
FIG. 4 is a top edge view of a trowel of one embodiment of the present invention along line 4-4 of FIG. 3.

As shown in FIGS. 2 and 4, flat surface blade 30 and corner blade 40 form a point which has an included angle 41 made by the two blades which is slightly larger than 90 degrees, preferably in the range of about 91 to 110 degrees, and in a preferred embodiment is 92 degrees. Handle 20 is positioned on flat surface blade 30 distal the intersection of flat surface blade 30 and corner blade 40. Handle 20 is positioned away from the edges of the blade which contact the viscous material of flat surface blade 30 and corner blade 40 thus keeping the handle from interfering with the blade edges during corner applications. Placing handle 20 relatively centered on a longitudinal plane along flat surface blade 30 maintains the balance of the tool which also allows necessary pressure to be applied to forward edge 33 during flat surface applications. The tool could not be used for flat surface applications if the handle was positioned at the vertex formed by flat surface blade 30 and corner blade 40 as is commonly positioned in tools used for inside corners and outside corners. Flat surface blade 30 has a forward edge 33 disposed opposite the handle used to facilitate spreading of the viscous material on a flat surface. Forward edge 33 of flat surface blade 30 is preferably configured to mimic a 4, 6, or 8 inch common putty knife. Flat surface blade 30 has inner face 37 which is used for applying viscous material to outside corners and outer face 35 is used to apply viscous material to an inside corner. Corner blade 40 has a forward edge 43 disposed opposite the handle having an inner face 47 for applying viscous material to outside corners and outer face 45 which is used to apply viscous material to an inside corner.

Figure 3:
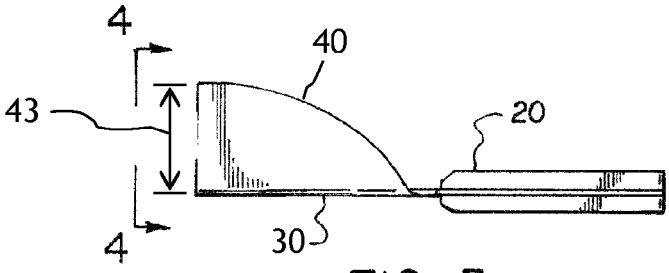
FIG. 3 is a side view of one embodiment of a trowel of the present invention along line 3-3 of FIG. 2.

FIG. 3 is a cross sectional view of the tool as viewed generally along line 3-3 of FIG. 2. Handle 20 is positioned within the plane formed by flat surface blade 30. Having the blade and handle in the same plane provides clearance for a user's hand while using the tool for inside corner applications while not obstructing the blade edges during outside corner applications or vice versa. Corner blade 40 has a forward edge 43 disposed opposite the handle to facilitate spreading of the viscous material in corner applications.

Figure 5:
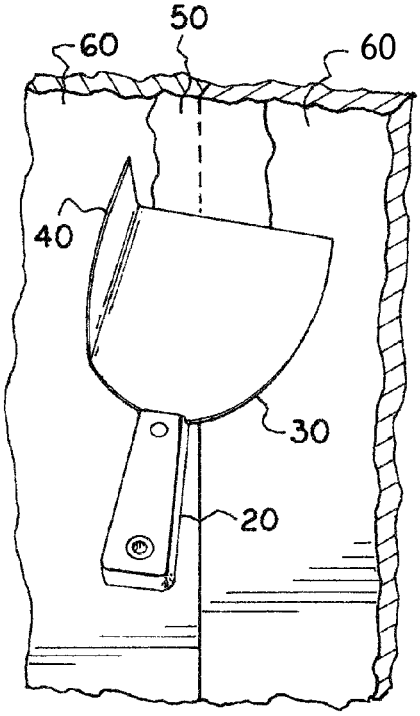
FIG. 5 is an illustrative example of a trowel of one embodiment of the present invention used on a flat surface.

FIG. 5 is an illustration of an embodiment of the trowel being used along a flat surface. Examples of flat surfaces on which the tool is used are joining sheets of material, such sheets of drywall or wood placed together to form a wall or filling cracks or seams within concrete or an asphalt driveway. Handle 20 is attached to flat surface blade 30 distal to the bend formed by blade 30 and corner blade 40. Handle 20 is positioned such that sufficient pressure can be placed along the outer face 35 of forward working edge 33 (as shown in FIG. 4) of flat surface blade 30 when spreading viscous material 50 along and within the seam formed by the junction of surfaces 60. In a preferred embodiment, the trowel is used to spread drywall joint compound along a seam between two portions of drywall. Traditionally, tape is applied along the seam to reinforce joint. The trowel of the present invention smoothly applies joint compound in one pass without snagging or pulling the tape from the joint. A common putty knife is ordinarily used in this type of application and the present invention trowel 10 is configured so that the balance and feel for the tool is virtually identical to a putty knife not having a corner blade 40.

Figure 6:
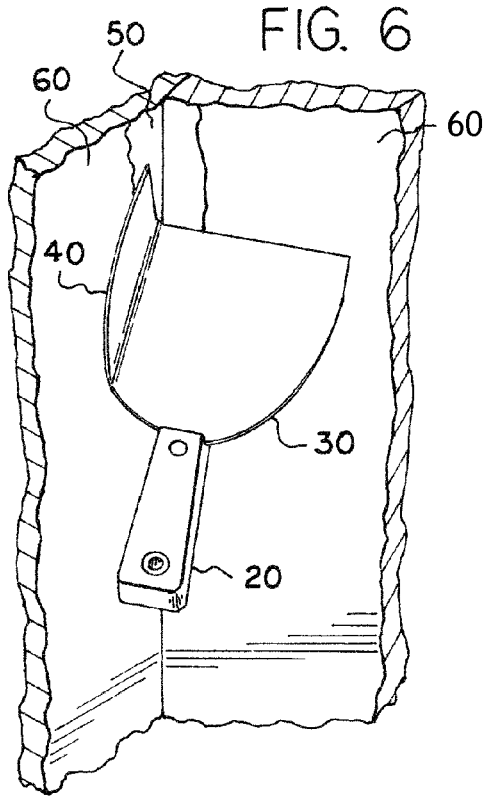
FIG. 6 is an illustrative example of a trowel of one embodiment of the present invention used in an inside corner.
Figure 7:
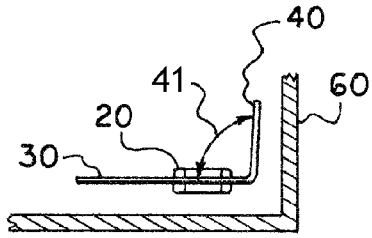
FIG. 7 is a top edge view of a trowel of one embodiment of the present invention before being placed into a corner.
Figure 8:
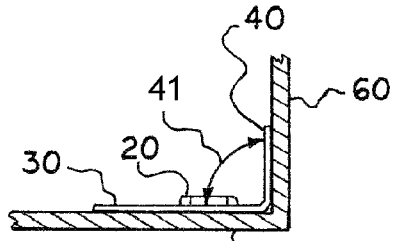
FIG. 8 is a top edge view of a trowel of one embodiment of the present invention positioned into a corner.

FIGS. 6 through 8 illustrate an embodiment of the present tool applying viscous material to an inside corner. Handle 20 forms a plane with flat surface blade 30. This planar relationship provides sufficient clearance for a user's hand when applying material 50 to an inside corner formed from by adjacent surfaces 60. Whereas the handle of a conventional inside corner tool is positioned at an angle to press the entire face of the tool against the wall, the handle of present invention is positioned so that the V-shaped point can be pressed into the corner at an angle and pulled down the length of the corner. In addition, the handle of the conventional inside corner tool is positioned so that it can only be used for an inside corner and cannot be used for an outside corner. The same is true regarding a conventional outside corner tool, i.e. the handle is positioned such that the tool can only be used on an outside corner. When applying viscous material along a surface, the inside corner tool pulls the material along the surface as the job is being completed. The problem with the conventional inside corner tool is that the entire surface of the blade is in contact with the wall as the tool is dragged down the inside corner. As a result, the viscous material collects at the bottom edge and is drawn away from the surface leaving portions of the corner with little to no material added and viscous material is collected on the outside of the tool around the user's hand. Additionally, because the entire face of the blade of the conventional inside corner tool is pressed into the corner, the sharp corner at the bottom of the tool tends to grab and pull the drywall tape during use. A user must then stop, reapply the tape, and begin again, greatly increasing the time needed to complete the job as well as wasting materials.

In the present invention, the apex of the point created by flat surface blade 30 in conjunction with corner blade 40 is pressed into an inside corner and only a portion of each blade contacts the wall as the tool applies material to an inside corner. Outer face 35 of edge 33 (as shown in FIG. 4) of flat surface blade 30 applies viscous material 50 to wall surface 60, while simultaneously, outer face 45 of edge 43 (as shown in FIG. 4) of corner blade 40 applies viscous material 50 to opposing corner wall surface 60. Handle 20 of the tool is in a planar relationship with flat surface edge 30 allowing a user to apply viscous material with the tool 10 at an angle incident to each surface 60. This incident angle allows the viscous material to remain in contact with the surface as tool 10 is dragged down the surface creating a smooth finished surface with an even layer of material applied along the entire length of the corner. Additionally, because only a portion of blade extensions are in contact with the walls (i.e. not the sharp corners of the tool), the present invention does not pull or rip the drywall tape during use. And because the tool is positioned at an angle against the corner, the viscous material does not collect and accumulate on the outer surface of the tool; the viscous material is pulled and collect under the part of the tool that is away from the wall. As a result the viscous material is pulled consistently and evenly down the corner and no material is wasted.

FIG. 7 shows the tool prior to contacting either surface of an inside corner. Opposing surfaces 60 in this example are two pieces of drywall joined together and covered with a viscous putty material and a tape to hide the seam of the joint. The tool is operatively arranged to evenly spread the viscous material over both surfaces simultaneously while also covering the tape and hiding the seam. It should be understood, angle 41 (formed by flat surface blade 30 and corner blade 40) is greater than 90 degrees, preferable between 91 and 110 degrees, and in a preferred embodiment is 92 degrees. Flat surface blade 30 and corner blade 40 are constructed of a rigid yet flexible material. This flexibility permits the tool to conform to the particular angle of the inside corner and accounts for any minor variabilities in the 90 degree corner junction.

As shown in FIG. 8, once the tool is pressed into an inside corner formed by surfaces 60, the angle 41 between flat surface blade 30 and corner blade 40 is decreased. The blade is configured rigidly but yet flexible enough to conform to the corner surface. When two sheets of drywall are placed together at roughly 90 degrees and a viscous material is applied, the resulting corner is never exactly 90 degrees. The flexibility of the tool and thus of angle 41 creates sufficient pressure to both surfaces 60 such that application of a viscous material can be made smoothly along both surfaces in one pass of the tool. This doubles efficiencies as only one pass is needed to cover both surfaces rather than applying material along one surface, waiting for that application to dry, and then applying material to the second surface. Additionally, in drywall applications where reinforcing tape is used, the tool does not apply too great of a pressure to pull or rip the tape from the corner nor does it present a sharp edge to the corner such that the tape can snag on the tool.

Figure 9:
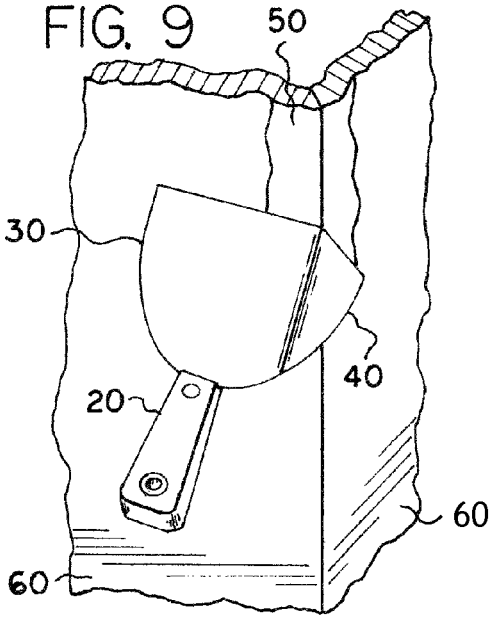
FIG. 9 is an illustrative example of a trowel of one embodiment of the present invention used on an outside corner.

FIG. 9 shows a tool of an embodiment of the present invention applying material to an outside corner. Handle 20 is in the plane with flat surface blade 30. Having the handle in this position allows the user to place edge 33 of flat surface blade 30 along surface 60 and edge 43 of corner blade 40 along opposing surface 60 without having the user's hand contact and be impeded by surface 60 as is this case if one were to attempt using a conventional inside corner tool on an outside corner.

Where the handle of a conventional outside corner tool is positioned at an angle to press the entire face of the tool against the wall, the handle of present invention is positioned so that the V-shaped point can be pressed into the outside corner at an angle and pulled down the length of the corner. When applying viscous material along a surface, the outside corner tool pulls the material along the surface as the job is being completed. The problem with the conventional outside corner tool is that the entire surface of the blade is in contact with the outside corner as the tool is dragged down the outside corner. As a result, the viscous material collects at the bottom edge and is drawn away from the surface leaving portions of the corner with little to no material added and viscous material is collected on the outside of the tool around the user's hand. Additionally, because the entire face of the blade of the conventional outside corner tool is pressed into the corner, the sharp corner at the bottom of the tool tends to grab and pull the drywall tape during use. A user must then stop, reapply the tape, and begin again, greatly increasing the time needed to complete the job as well as wasting materials.

In the present invention, the apex of the point created by flat surface blade 30 in conjunction with corner blade 40 surrounds an outside corner and only a portion of each blade contacts the wall as the tool as the tool is pressed into the corner at an angle as it applies material to an outside corner. Only a portion of the tool (not the entire inner face of the tool as would be the case with a conventional blade) applies viscous material 50 to the outside corner of the wall formed by surfaces 60. Handle 20 of the tool is in a planar relationship with flat surface edge 30 allowing a user to apply viscous material with the tool 10 at an angle incident to each surface 60. This incident angle allows the viscous material to remain in contact with the surface as tool 10 is dragged down the surface creating a smooth finished surface with an even layer of material applied along the entire length of the corner. Additionally, because only a portion of blade extensions are in contact with the walls, the present invention does not pull or rip the drywall tape during use. And because the tool is positioned at an angle against the corner the viscous material does not collect and accumulate on the outer surface of the tool; the viscous material is pulled consistently and evenly down the corner and no material is wasted.

As shown in FIGS. 2 and 4, the angle 41 made by flat surface blade 30 and corner blade 40 is greater than 90 degrees and is preferentially between 91 and 110 degrees and in a preferred embodiment is 95 degrees. Having an angle slightly greater than 90 degrees allows for variabilities in the outside corner angle. In drywall applications, the greater than 90 degree angle allows joint compound to be applied over reinforcing tape or reinforcing metal corner flashing without pulling the tape or metal from the corner. If blades 30 and 40 were aligned at a 90 degree angle, the application of the joint compound would be too severely constrained, resulting in the tape being torn from the corner. Flat surface blade 30 is used in conjunction with corner blade 40 in applying material to an outside corner. Inner face 37 of edge 33 (as shown in FIG.4) of flat surface blade 30 applies viscous material 50 to wall surface 60, while inner face 47 of edge 43 (as shown in FIG. 4) of corner blade 40 applies viscous material 50 to the opposing wall surface.

Thus, as shown the embodiment of the trowel of the present invention is configured to apply viscous material to flat surfaces, inside corners, and outside corners using a single tool without requiring a user to physically manipulate the tool prior to use. The three-in-one tool of the present invention is designed for drywall and joint compound applications, but can be used for any application requiring application of viscous material such as caulking, or sealing or repairing concrete or asphalt.

Although the invention has been described with reference to certain preferred embodiments, it will be appreciated by those skilled in the art that modifications and variations may be made without departing from the spirit and scope of the invention. It should be understood that applicant does not intend to be limited to the particular details described above and illustrated in the accompanying drawings.

What is claimed is:

1. A tool for spreading viscous material comprising:

(a) a sheet of resilient material generally shaped in a half circle; having a inner face and an outer face, a rounded handle attachment edge and a straight forward edge; said sheet being bent from the outer face toward the inner face along a bend line to form a V-shaped point to shape an offset corner blade and at least one substantially flat surface blade from said straight forward edge, and (b) a handle for gripping said tool attached to said rounded handle attachment edge of said sheet distal said bend line.

2. A tool according to claim 1 wherein said sheet is made of metal.

3. A tool according to claim 1 wherein said tool is made of molded plastic.

4. A tool according to claim 1 wherein said handle is centered on said rounded edge of said sheet.

5. A tool according to claim 1 wherein said V-shaped point has an included angle in the rangeof about between 91 degrees to 110 degrees.

6. A tool for spreading viscous material comprising:

(a) a sheet of resilient material generally shaped in a half circle; having a inner face and an outer face, a rounded handle attachment edge and a straight forward edge; said sheet being bent from the outer face toward the inner face along a bend line to form a V-shaped point to shape an offset corner blade and at least one substantially flat surface blade from said forward edge, wherein said V-shaped point has an included angle of about 92 degrees and (b) a handle for gripping said tool attached to said a rounded handle attachment edge of said sheet distal said bend line.

7. A tool according to claim 6 wherein said sheet is made of metal.

8. A tool according to claim 7 wherein said metal is aluminum.

9. A tool according to claim 6 wherein said tool is made of molded plastic.

* * * * *